United States Patent [19]

Khan et al.

[11] 3,995,978

[45] Dec. 7, 1976

[54] HYDRAULIC FLUID PRESSURE DEVICE AND PORTING ARRANGEMENT THEREFOR

[75] Inventors: Farooq A. Khan; Leslie L. Ecklund, both of Battle Creek, Mich.

[73] Assignee: Eaton Corporation, Cleveland, Ohio

[22] Filed: Apr. 4, 1975

[21] Appl. No.: 565,033

[52] U.S. Cl. ..... 418/171

[51] Int. Cl.[2] ..... F04C 15/02; F04C 1/06

[58] Field of Search ..... 418/171, 166

[56] References Cited

UNITED STATES PATENTS

| | | | |
|---|---|---|---|
| 2,373,368 | 4/1945 | Witchger | 418/166 X |
| 2,739,538 | 3/1956 | Witchger | 418/171 X |
| 2,872,872 | 2/1959 | Quintilian | 418/171 X |
| 2,968,251 | 1/1961 | Eames, Jr. et al. | 418/171 X |
| 3,129,875 | 4/1964 | Cirillo | 418/171 |
| 3,551,079 | 12/1970 | Brundage | 418/171 X |
| 3,695,791 | 10/1972 | Brundage | 418/171 X |

*Primary Examiner*—C. J. Husar
*Assistant Examiner*—Leonard Smith
*Attorney, Agent, or Firm*—Teagno & Toddy

[57] ABSTRACT

A fluid pressure device such as a hydraulic pump is provided having an improved inlet porting arrangement to permit a greater output flow rate for a given input speed. The pump is of the type including a housing defining an inlet chamber and an outlet chamber and inner and outer rotors having spaced apart axes of rotation defining a line of eccentricity. The teeth of the rotors interengage to define a plurality of expanding and contracting volume chambers. The housing includes an end face adjacent the rotors at which the inlet chamber defines an inlet port communicating with the expanding volume chambers. The inlet port is generally arcuate and extends circumferentially from approximately the line of eccentricity on one side of the device to the line of eccentricity on the opposite side of the device. Preferably, the inlet port includes a pair of terminal portions of reduced radial width to prevent cross-porting between the inlet port and the outlet port when one of the teeth of the outer rotor is circumferentially aligned with the terminal portion.

8 Claims, 7 Drawing Figures

FIG. 4
PRIOR ART
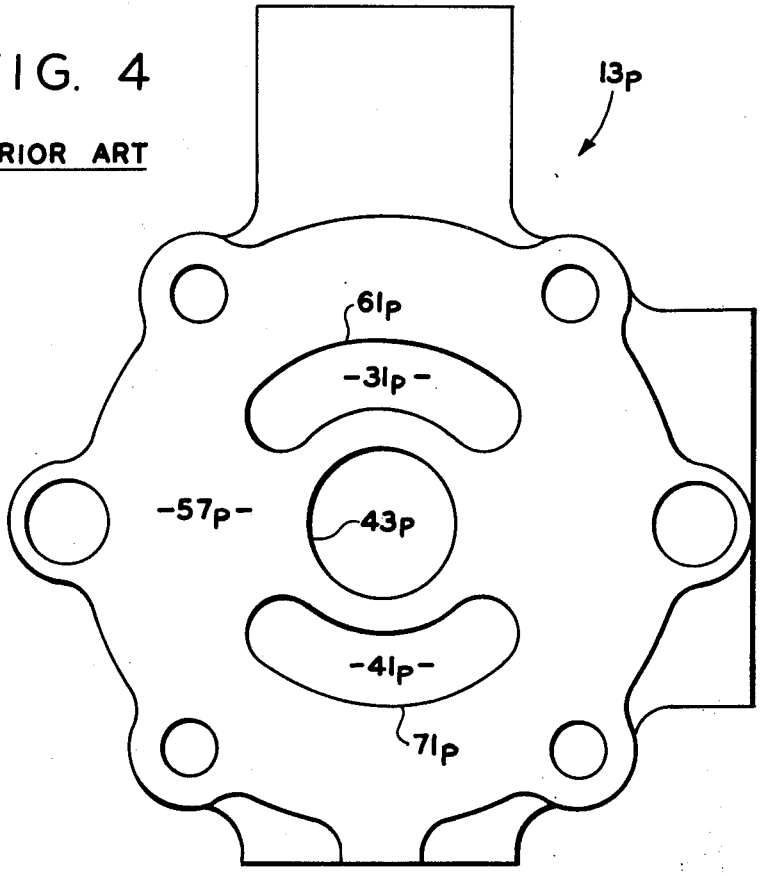
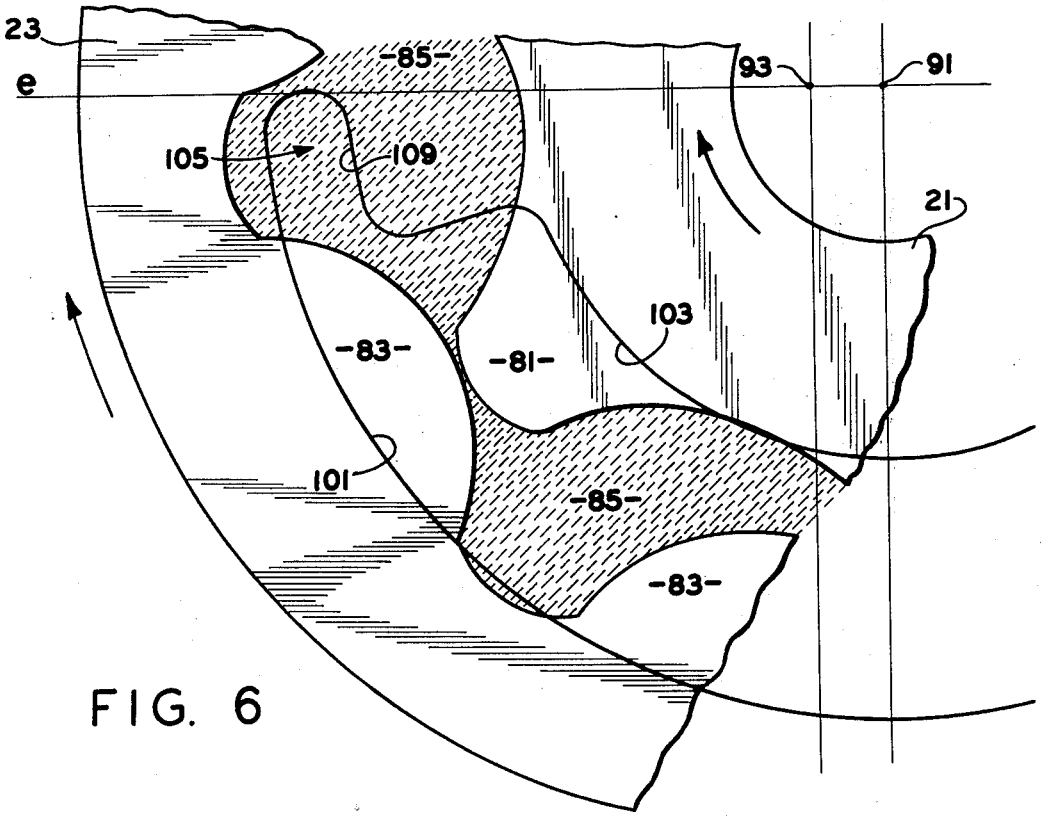
FIG. 6

HYDRAULIC FLUID PRESSURE DEVICE AND PORTING ARRANGEMENT THEREFOR

BACKGROUND OF THE INVENTION

The present invention relates to hydraulic fluid pressure devices, and more particularly, to hydraulic devices such as motors and pumps in which an inner rotor is eccentrically disposed within an outer rotor, and each of the rotors rotates about its center or axis of rotation, the interengagement of the teeth of the rotors defining expanding and contracting volume chambers.

More specifically, the present invention relates to hydraulic devices of the type described above, including a housing or body defining an inlet port in communication with the expanding volume chambers and an outlet port in communication with the contracting volume chambers.

An example of such a hydraulic device is the "charge pump" or "make-up" pump frequently used as part of a hydrostatic transmission to provide make-up fluid to compensate for leakage losses during operation. This make-up fluid is pumped at a relatively low pressure (typically 150–250 psi, $1.03 \times 10^6$ to $1.72 \times 10^6$ Pa) into a "low pressure" portion of the hydraulic circuit. This charge pump or make-up pump may be driven by a shaft from the main engine and is commonly mounted on the main system pump (a "high pressure" pump) which is typically a reciprocating, axial piston pump. Thus, although it will become apparent that the present invention is well suited for use with either a gerotor pump or a gerotor motor of the type in which each of the rotors rotates about its own axis and utilizes what is frequently referred to as "kidney" porting (generally arcuate inlet and outlet ports), the invention is especially adapted for use with gerotor pumps such as the charge pumps of hyrostatic transmissions, and will be described in connection therewith. Furthermore, although the invention may be utilized with a device which is "unidirectional", it is especially advantageous when used in a hydraulic device which is "bidirectional", i.e., pressurized fluid is pumped from the outlet port in response to rotation of the input shaft in either direction.

In charge pumps of the type described, as well as in most other gerotor devices which use kidney porting, it is highly desirable for the pump output, measured in g.p.m. (cubic meters per minute) to increase in a linear relationship as the input speed (in rpm) increases. However, in prior art gerotor pumps, the output g.p.m. has deviated from the desired linear relation with the input rpm at an undesirably low rpm level. This has been caused primarily by the inability to introduce a sufficient volume of fluid into the expanding volume chambers, through the inlet port defined by the pump body or housing thus causing cavitation and a drop in volumetric efficiency. As a result, in order to achieve a desired pump outlet, it has been necessary to provide a higher input speed for a given pump (which in turn caused higher cavitation and substantial reduction in pump performance and life) or in some cases, even a larger pump of greater capacity. In either case, it has been necessary to use an excessive amount of input energy to achieve the desired output flow rate. A typical prior art inlet port will be illustrated in connection with the subsequent description of the present invention.

It has been possible with prior art inlet ports to achieve fairly good filling characteristics with an inlet port at only one end of the gerotor set in unidirectional devices. It has also been possible with prior art porting arrangements to achieve fairly good filling characteristics on both unidirectional and bidirectional devices by providing inlet ports at both ends of the gerotor, which adds unnecessary complexity and cost to the device.

SUMMARY OF THE INVENTION

Accordingly, it is an object of the present invention to provide an improved gerotor device, and an inlet porting arrangement therefore, which has improved filling characteristics at higher input speeds and therefore, reduces inlet cavitation.

It is a related object of the present invention to provide an inlet porting arrangement which achieves the above-stated object in both unidirectional and bidirectional gerotor devices without the necessity of inlet ports at each end of the gerotor set.

It is another related object of the present invention to provide such a gerotor device in which it is possible to maintain the generally linear relation between the output flow rate and the input speed at higher input speeds than was previously possible.

It is a more specific object of the present invention to provide a gerotor device and an inlet porting arrangement wherein the inlet port communicates with more of the area of the expanding volume chambers, without causing cross-porting, i.e., communication between the inlet port and the contracting volume chambers.

The above and other objects of the present invention, which will become apparent upon a reading of the following detailed description, are accomplished by the provision of an improved hydraulic device of the type comprising a housing defining an inlet chamber and an outlet chamber, an internally-toothed member having an axis of rotation and an externally-toothed member eccentrically disposed within the internally-toothed member, and also having an axis of rotation, the axes of rotation defining a line of eccentricity. A shaft means transmits a rotational input to one of the tooth members causing each of them to rotate about its respective axis of rotation. The teeth of the members interengage to define a plurality of expanding and contracting volume chambers. The housing has an end face adjacent the tooth members and the inlet and outlet chambers define, at the end face, an inlet port and outlet port respectively. The inlet port communicates with the expanding volume chambers and the oulet port communicates with the contracting volume chambers. The inlet port is generally arcuate or kidney shaped, and extends circumferentially from approximately the line of eccentricity on one side of the device to approximately the line of eccentricty on the opposite side of the device. The internally and externally toothed members define a pair of generally diametrically opposed sealing points separating the expanding and contracting volume chambers. The sealing points are disposed near the line of eccentricity and move a small amount relative thereto during rotation of the toothed members. Thus, the inlet port extends from adjacent the one sealing point to adjacent the other sealing point.

In accordance with a more limited aspect of the present invention, the inlet port includes a pair of terminal portions which are narrower in the radial direction than the remainder of the inlet port, the entire area of each terminal portion being in sealing engagement with a tooth of the internally-toothed member when that tooth is circumferentially aligned with the particular terminal portion and is disposed between the largest expanding volume chamber and the largest contracting volume chamber, and therefore defines, with the externally-toothed member, one of the sealing points.

BRIEF DESCRIPTION OF THE DRAWINGS

FIG. 4 is a rear elevation of a pump body, similar to FIG. 3, illustrating a typical prior art inlet porting arrangement.

FIG. 6 is a fragmentary view similar to FIG. 5, but on a larger scale, illustrating the operation of the present invention with the inner and outer rotors having rotated a few degrees from the position shown in FIG. 5.

DESCRIPTION OF THE PREFERRED EMBODIMENT

Figure 1:
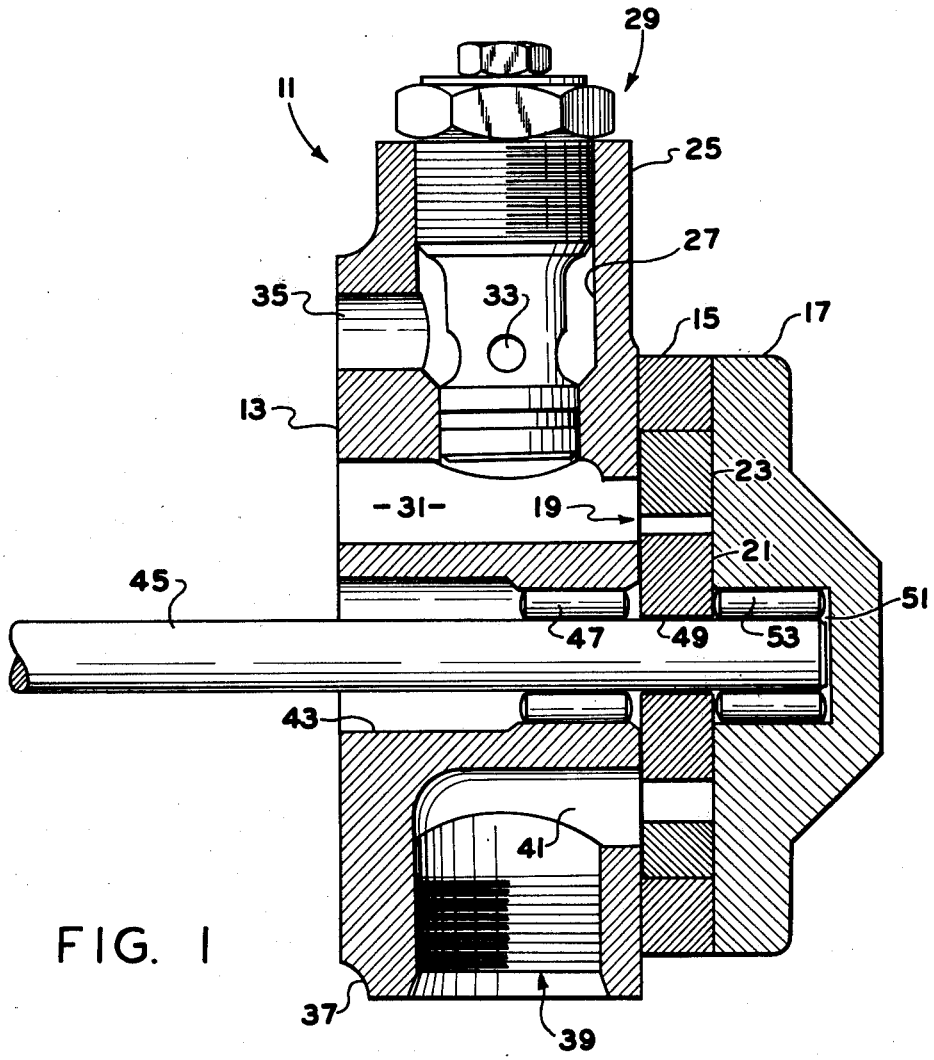
FIG. 1 is a vertical cross section of a gerotor pump to which the present invention may be applied.

Referring now to the drawings, which are for the purpose of illustrating a preferred embodiment of the invention, and not for limiting the same, FIG. 1 is a vertical cross section of a typical gerotor pump, generally designated 11, of the type which may be used as a charge pump or make-up pump in a hydrostatic transmission. The gerotor pump 11 includes a pump body 13, a spacer 15 and a pump cover 17. Disposed between the body 13 and cover 17, and within the spacer 15 is a gerotor set, generally designated 19, comprising an inner rotor 21 and an outer rotor 23.

The pump body 13 includes an upwardly extending boss 25 which defines a bore 27, and in threaded engagement with the upper portion of bore 27 is a pressure relief valve 29 which, in the subject embodiment, is pressure sensitive, i.e., opens in response to pressure, but forms no part of the present invention and is included merely as part of the hydraulic circuit of the hydrostatic transmission in which the gerotor pump 11 is used. At the lower end of the bore 27 is an outlet chamber 31 which receives pressurized fluid from the gerotor set 19 as will be described subsequently. In the subject embodiment, pressurized fluid in outlet chamber 31 enters the hydraulic circuit of hydrostatic transmission as described previously when the pressure relief valve 29 is closed, and when the pressure exceeds the relief valve setting, the valve 29 opens and the pressurized fluid flows upward through the valve 29, then radially outward through a plurality of orifices 33 into the bore 27, from which it flows by way of a passage 35 and is returned to the system reservoir (not shown) through the hydrostatic transmission pump case.

Oppositely disposed from the boss 25 is a boss 37 defining an inlet bore 39 which empties into an inlet chamber 41, from which inlet fluid is fed to the gerotor set 19 as will be described in greater detail subsequently.

The pump body 13 further defines a central bore 43 into which extends an input shaft 45, which is guided and supported within the bore 43 by a set of roller bearings 47. The shaft 45 extends through a central opening 49 in the inner rotor 21 which is in fixed engagement with the shaft 45, such as by means of a key member or other suitable means (not shown). The inner shaft 45 extends into an opening 51 in the pump cover 17 and the shaft is guided and supported within the opening 51 by a set of roller bearings 53.

Figure 2:
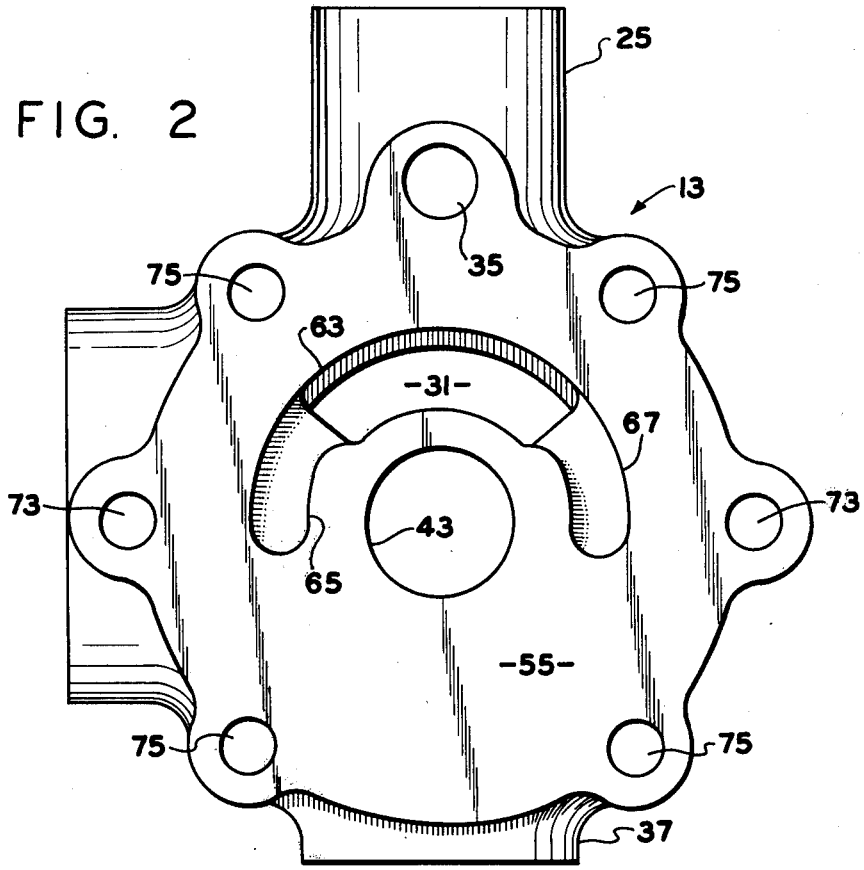
FIG. 2 is a front elevation of the pump body, looking toward the right in FIG. 1.
Figure 3:
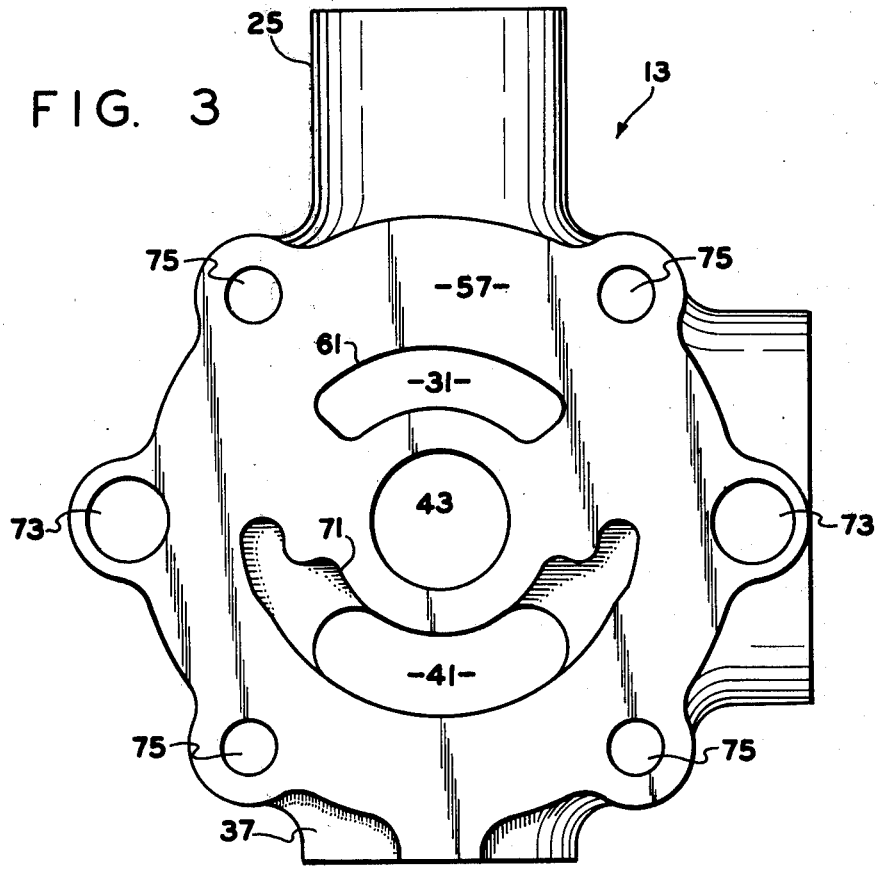
FIG. 3 is a rear elevation of the pump body, looking toward the left in FIG. 1.

Referring now to FIGS. 2 and 3, there are shown front and rear elevations, respectively, of the pump body 13. The pump body 13 includes a front face 55 (FIG. 2), and a rear face 57 (FIG. 3) which is in sealing engagement with the gerotor set 19 and with the spacer 15. Referring to FIG. 3, it may be seen that the outlet chamber 31 defines, at the rear face 57, an outlet port 61 and the outlet chamber 31 further defines, at the front face 55, a pump outlet 63 including a pair of extended portions 65 and 67, which are included only to ensure communication of the outlet chamber 31 to the hydrostatic transmission hydraulic circuit. Referring again to FIG. 3, the inlet chamber 41 defines, at the rear face 57, an inlet port 71.

The pump body 13 defines a pair of oppositely disposed bores 73, which are larger adjacent the rear face 57 than adjacent the front face 55, and the bores 73 align with similar, mating bores in the spacer 15 and pump cover 17 to permit fastening of the body 13, spacer 15 and cover 17 in tight sealing engagement, as by a pair of dowels (not shown). Similarly, the pump body 13 defines four spaced apart bores 75, also aligned with mating bores in the spacer 15 and pump cover 17, to permit attachment of the entire gerotor pump 11 to another member, such as the main pump (not shown) of a hydrostatic transmission, as by means of a plurality of bolts passing through the bore 75 and into threaded engagement with mating, threaded bores in the main pump.

Referring now to FIG. 4, which is a rear elevation similar to FIG. 3, like elements are referenced by the same numerals, but followed by the letter "p". Thus, in the illustration of a typical prior art kidney porting arrangement in FIG. 4, the pump body **13*p* defines an outlet chamber 31*p*, a central bore 43*p*, an inlet chamber 41*p* and a rear face 57*p*. The outlet chamber 31*p* defines, at the rear face 57*p*, an outlet port 61*p*, while the inlet chamber 41*p* defines, at the rear face 57*p*, an inlet port 71*p*. Typically, the generally kidney-shaped or arcuate inlet port 71*p*** has had a circumferential extent of about 145°–150° which, as will be appreciated from the remaining description of the present invention, limits the ability of the expanding volume chambers of the gerotor set to be completely filled, and as a result, limits the output flow rate of the device.

Figure 5:
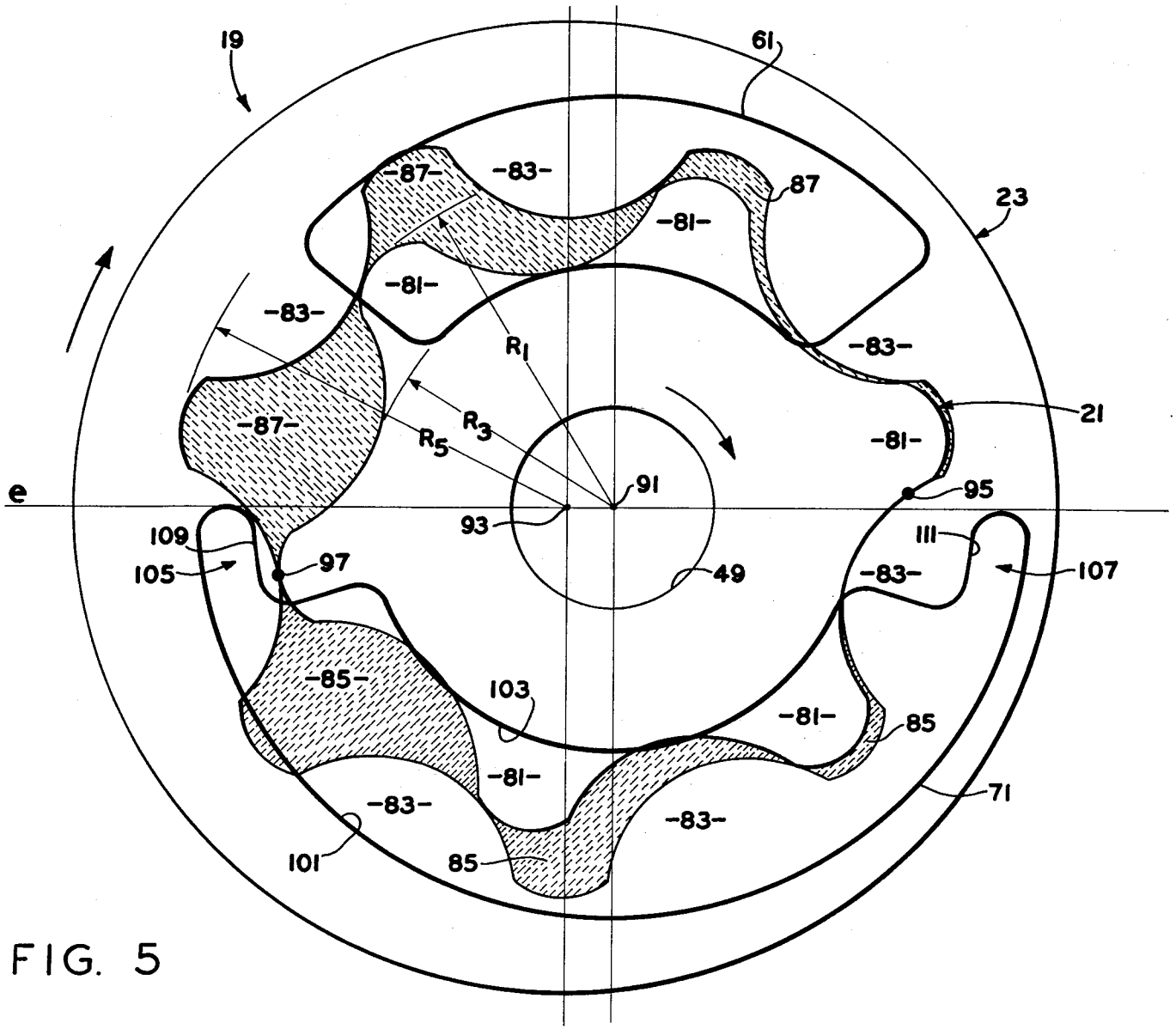
FIG. 5 is an enlarged elevation of the gerotor set, looking toward the right in FIG. 1, with the outline of the inlet and outlet ports superimposed to illustrate the operation of the invention.

Referring now to FIG. 5, which illustrates the operation of the present invention, there is shown the outer rotor 23 and the inner rotor 21 positioned eccentrically therein. The inner rotor 21 includes six external teeth 81 and the outer rotor 23 includes seven internal teeth 83, the external teeth 81 and internal teeth 83 cooperating to define a plurality of expanding volume chambers 85 and a plurality of contracting volume chambers 87. Partly for purposes of clarity of the drawings, the chambers 85 and 87 are illustrated as containing fluid, and are cross-hatched therefor. The expanding volume chambers 85 are in communication with inlet port 71 and the contracting volume chambers 87 are in communication with outlet port 61.

The inner rotor 21 has an axis of rotation 91 and the outer rotor 23 has an axis of rotation 93, the axes of rotation 91 and 93 defining a line of eccentricity "*e*". The inner rotor 21 and outer rotor 23 are in sealing engagement with each other at a pair of oppositely disposed sealing points 95 and 97, the sealing points 95 and 97 being movable with respect to the line of eccentricity *e* during rotation of the inner and outer rotors 21 and 23.

The inner rotor 21 defines a major circle radius $R_1$ and a base circle $R_3$, both taken from axis 91. The outer rotor 23 defines a base circle radius $R_5$, taken from axis 93. As is well known in the art, the distance between axes 91 and 93 is referred to as the eccentricity of the gerotor set 19. As is shown by the pair of directional arrows, the rotors 21 and 23 are rotating clockwise in the illustration of FIG. 5.

The inlet port 71 is defined by a generallly arcuate outer surface 101 and a generally arcuate inner surface 103, which surfaces meet and terminate in a pair of terminal portions 105 and 107. The terminal portions 105 and 107 are illustrated as being substantially narrower in a radial direction than the remainder of the inlet port 71 because, as may best be seen by referring to the terminal portion 105, if the terminal portion 105 were any wider than is shown in the subject embodiment, cross-porting would occur, i.e., the inlet port 71 would communicate through terminal portion 105 with a contracting volume chamber 87.

In view of the stated object of the present invention that the inlet port 71 should communicate with as much of the total area of the expanding volume chambers 85 as is possible, it will be appreciated that the terminal portion 105 or 107 (depending upon the direction of rotation), substantially improves the filling characteristics of the pump by providing an increase in the total inlet flow area. In view of the desired reversibility of the gerotor pump 11, the outer and inner arcuate surfaces 101 and 103 which define inlet port 71 are preferably made arcuate about the axis of rotation 91 of the inner rotor 21. Therefore, in the preferred embodiment, the arcuate outer surface 101 is disposed from the axis of rotation 91 a distance at least equal to the base circle radius $R_5$ of the outer rotor 23, and preferably greater. Similarly, the arcuate inner surface 103 is disposed from the axis of rotation 91 a distance approximately equal to the base circle radius $R_3$ of the inner rotor 21. Referring again to the terminal portions 105 and 107, they are defined at the outer periphery thereof by the arcuate outer surface 101, and at the inner periphery thereof by inner surfaces 109 and 111, respectively. In order to prevent cross-porting, as discussed previously, the inner surfaces 109 and 111 should be disposed from the axis of rotation 91 a distance at least equal to the major circle radius $R_1$ of the inner rotor 21, and preferably, should be configured such that the entire area of the terminal portion (e.g. terminal portion 105) is in sealing engagement with a tooth 83 of the outer rotor 23 when the particular tooth 83 is in circumferential alignment with the terminal portion, as in FIG. 5. This situation occurs when the tooth 83 is disposed between the largest of the expanding volume chambers 85 and the largest of the contracting volume chambers 87.

Referring now to the enlarged, fragmentary view shown in FIG. 6, similar to that in FIG. 5, the inner and outer rotors 21 and 23 have rotated a small number of degrees about their respective axes of rotation 91 and 93 such that the sealing point 97 between the rotors 21 and 23 has temporarily moved upward of the line of eccentricity *e* and is not shown in FIG. 6. The advantages of the present invention may be better appreciated in connection with FIG. 6 wherein the terminal portion 105 is now in alignment with the uppermost or largest volume chamber 85, which, in the position shown, is just reaching its largest volume, and therefore, rather than being supplied with fluid by only the relatively small part of the wide portion of the inlet port 71 in communication therewith, or not being supplied at all, the expanding volume chamber 85 is receiving as much fluid as it can hold through the terminal portion 105. Therefore, as the gerotor set rotates relative to the inlet port 71 the terminal portion 105 will be circumferentially aligned, alternatively, with a tooth 83 of the outer rotor 23 and with the largest of the expanding volume chambers 85.

Referring again to FIG. 5, it should be noted that if it is desired to reverse the direction of rotation of the input shaft 45 the pump may still be operated in the same manner, i.e., fluid being fed to the expanding volume chambers 85 through the inlet port 71 and expelled under pressure from the contracting volume chambers 87 through the outlet port 61. This reversal of operation may be affected merely by rotating the spacer 15 by 180° which, as may be seen in FIG. 5, reverses the eccentricity of the gerotor set, i.e., places the axis of rotation 93 on the right side of the axis of rotation 91. Then, as the inner and outer rotors 21 and 23 rotate counterclockwise, rather than clockwise, the terminal portion 107 will function in the same manner as was described previously in reference to terminal portion 105. Thus, it will be appreciated that for a device which is intended to be unidirectional, it is not necessary in order to practice the present invention to provide both of the terminal portions 105 and 107, but rather, to provide a configuration at the end of the inlet port 71 which permits a substantial flow of fluid into the largest expanding volume chamber 85.

EXAMPLES

The following examples have been included to illustrate the extent to which the filling characteristics, and therefore, the output flow capacity may be improved through use of an inlet porting arrangement as disclosed herein. In each of the examples, the gerotor set was one in which the inner rotor had six teeth and the outer rotor had seven teeth for a total displacement of 1.70 cu. inches per revolution (28.1 cc/rev.). The hydraulic fluid had an inlet temperatue of 180° F. (82° C), at an vacuum of 6 in. Hg. (15.2 cm Hg.). The data under the heading "Prior Art" is for a pump having an inlet port substantially as shown in FIG. 4, while the data under the heading "Invention" is for a pump having an inlet port in accordance with the present invention as described above and shown in FIGS. 3, 5 and 6.

EXAMPLE A

In this example, the pump was run with the relief valve being set to open at a flow rate of 3 g.p.m. ($1.135 \times 10^{-2}$ m³/min.), at 150 psi ($1.033 \times 10^6$ Pa).

| Speed (rpm) | Flow - g.p.m. ($m^3$/min. × $10^{-2}$) Prior Art | Invention |
|---|---|---|
| 800 | 5.28 (1.99) | 4.66 (1.76) |
| 1200 | 8.07 (3.05) | 7.46 (2.82) |
| 1500 | 10.11 (3.82) | 9.52 (3.60) |
| 1800 | 12.20 (4.61) | 11.55 (4.37) |
| 2100 | 13.83 (5.23) | 13.53 (5.12) |
| 2400 | 15.77 (5.96) | 15.64 (5.91) |
| 2700 | 17.88 (6.65) | 17.82 (7.04) |
| 3000 | 19.27 (7.29) | 19.94 (7.54) |
| 3300 | 20.24 (7.66) | 21.93 (8.30) |
| 3600 | 20.48 (7.75) | 23.59 (8.92) |
| 3900 | 20.18 (7.63) | 24.90 (9.42) |
| 4200 | 19.63 (7.42) | 26.06 (9.86) |
| 4500 | | 26.54 (10.04) |
| 4800 | | 26.90 (10.18) |

EXAMPLE B

In this example, the pump was run with the relief valve set to open at a flow rate of 3 g.p.m. (1.135 × $10^{-2}$ $m^3$/min.), at 250 psi (1.72 × $10^6$ Pa), the data being illustrated graphically in FIG. 7.

| Speed (rpm) | Flow - g.p.m. ($m^3$/min. × $10^{-2}$) Prior Art | Invention |
|---|---|---|
| 800 | 5.08 (1.92) | 4.14 (1.56) |
| 1200 | 7.80 (2.95) | 6.96 (2.63) |
| 1500 | 9.91 (3.75) | 9.05 (3.42) |
| 1800 | 11.85 (4.48) | 11.06 (4.18) |
| 2100 | 13.89 (5.25) | 13.23 (5.00) |
| 2400 | 15.58 (5.89) | 15.28 (5.78) |
| 2700 | 17.46 (6.60) | 17.09 (6.46) |
| 3000 | 18.97 (7.18) | 19.21 (7.27) |
| 3300 | 20.00 (7.57) | 21.38 (8.09) |
| 3600 | 20.34 (7.63) | 23.21 (8.78) |
| 3900 | 19.87 (7.52) | 24.48 (9.26) |
| 4200 | 19.39 (7.33) | 25.75 (9.74) |
| 4500 | | 26.24 (9.93) |

Figure 7:
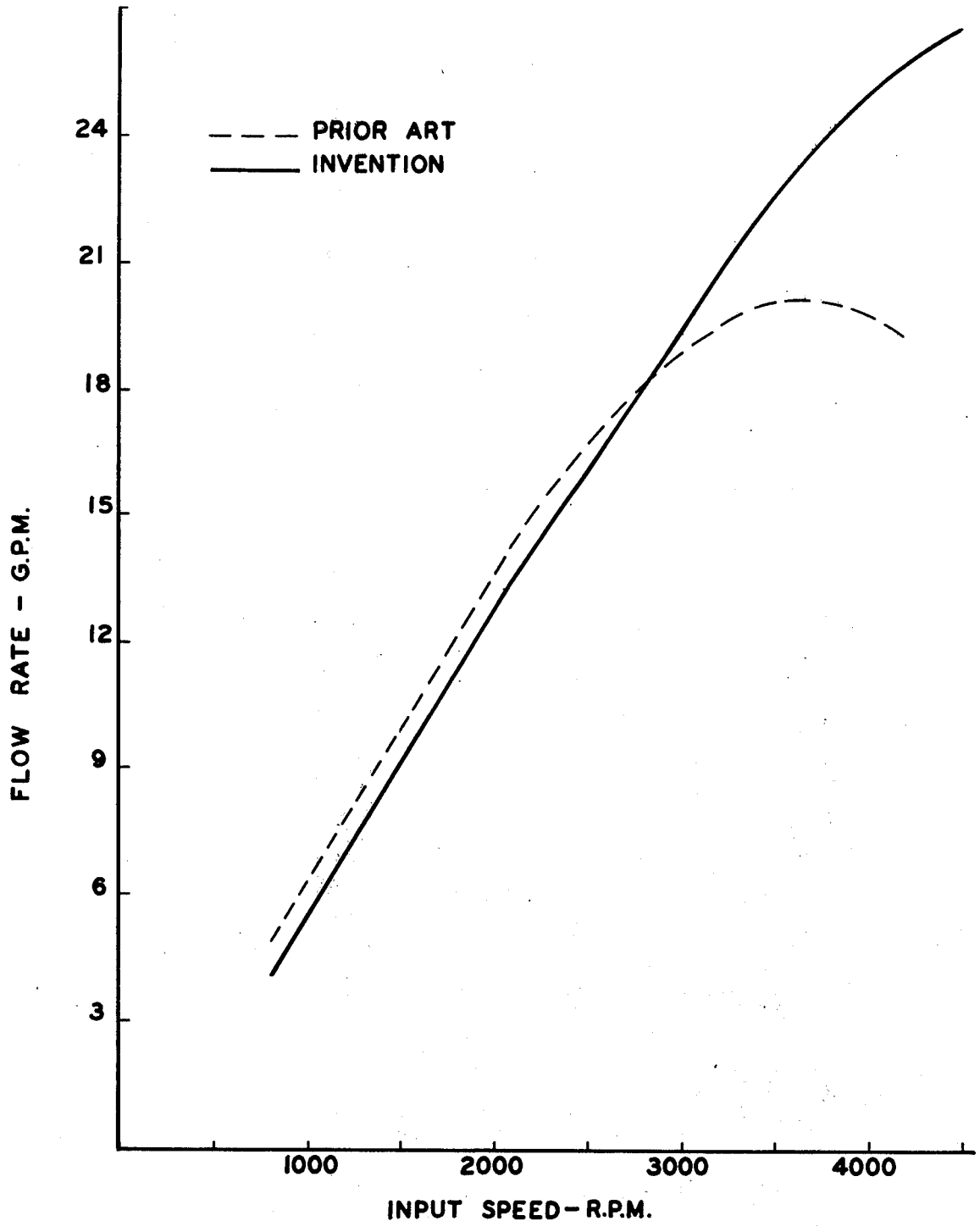
FIG. 7 is a graph of flow rate versus input speed, utilizing the inlet port of the present invention versus that of the prior art illustrated in FIG. 4.

As may be seen from the above data, viewed in conjunction with the graph of FIG. 7, the use of a typical prior art inlet porting arrangement, such as inlet port 71p in FIG. 4, results in the output flow rate deviating from its desried linear relationship with the input speed at about 3,000 rpm. Furthermore, the output flow rate in both examples actually began to decrease with increasing input speed at about 3,600 rpm, whereas the input port 71 of the present invention, the outlet flow rate was still increasing with increasing input speed on a nearly linear basis at 4,500 rpm. It may also be noted that in both examples, at an input speed of about 4,200 rpm, the output flow rate using the inlet port of the present invention was at least 20% greater than with the prior art inlet porting arrangement.

The invention has been described in detail sufficient to enable one of ordinary skill in the art to make and use the same. Modifications and alterations of the preferred embodiment will occur to others upon a reading of the specification and it is our intention to include all such modifications and alterations insofar as they come within the scope of the appended claims.

We claim:

1. A hydraulic device comprising:

a. a housing defining an inlet chamber and an outlet chamber;

b. an internally-toothed member having an axis of rotation and an externally-toothed member eccentrically disposed within said internally-toothed member and having an axis of rotation, said axes of rotation being spaced apart;

c. shaft means operatively connected to one of said toothed members, as each of said toothed members rotates about its respective axis of rotation;

d. the teeth of said toothed members interengaging to define a plurality of expanding and contracting volume chambers;

e. said housing including an end face adjacent said toothed members, said inlet chamber and said outlet chamber defining at said end face, an inlet port and an outlet port, respectively, said inlet port communicating with said expanding volume chambers and said outlet port communicating with said contracting volume chambers;

f. said toothed members defining generally diametrically opposed first and second sealing points, said first sealing point separating the largest of said contracting and expanding volume chambers and said second sealing point separating the smallest of said contracting and expanding volume chambers; and g. said inlet port being generally arcuate and extending circumferentially from adjacent said first sealing point to adjacent said second sealing point, said inlet port including a first terminal portion disposed adjacent said first sealing point to remain in fluid communication with the largest of said expanding volume chambers for several degrees of rotation of said internally-toothed member and said externally-toothed member after said largest of said expanding volume chambers begins to contract, to improve the inlet flow characteristics of the device.

2. A hydraulic pump operable in response to a bidirectional rotary input, comprising;

a. a housing defining an inlet chamber and an outlet chamber;

b. an internally-toothed member having an axis of rotation and an externally-toothed member eccentrically disposed within said internally-toothed member and having an axis of rotation, said axes of rotation being spaced apart and defining a line of eccentricity;

c. shaft means operable to transmit said rotary input to one of said toothed members, each of said toothed members rotating about its respective axis of rotation;

d. the teeth of said toothed members interengaging to define a plurality of expanding and contracting volume chambers;

e. said housing including an end face adjacent said toothed members, said inlet chamber and said outlet chamber defining at said end face, an inlet port and an outlet port, respectively, said inlet port communicating with said expanding volume chambers and said outlet port communicating with said contracting volume chambers;

f. said inlet port being generally arcuate and including a primary portion having a radial width approximately equal to the radial width of the largest expanding volume chambers; and g. said inlet port including a first terminal portion extending from said primary portion to about said line of eccentricity on the side of the device having the largest expanding and contracting volume chambers and a second terminal portion extending from said primary portion to about said line of eccentricity on the side of the device having the smallest expanding and contracting volume chambers, each of said first and second terminal portions being in fluid communication with said primary portion and having a radial width substantially less than said radial width of said primary portion, said first terminal portion being disposed to communicate periodically with the largest expanding volume chamber when said toothed members rotate in one direction and said second terminal portion being disposed to communicate periodically with the largest expanding volume chamber when said toothed members rotate in the opposite direction with the eccentricity thereof reversed.

3. The device of claim 2 wherein the inner periphery of said terminal portions is disposed radially outward from the axis of said externally-toothed member a distance greater than one-half the major circle diameter of said externally-toothed member.

4. A hydraulic device comprising:

a. a housing defining an inlet chamber and an outlet chamber;

b. an internally-toothed member having an axis of rotation and an externally-toothed member eccentrically disposed within said internally-toothed member and having an axis of rotation, said axes of rotation being spaced apart and defining a line of eccentricity;

c. shaft means associated with one of said toothed members, each of said toothed members rotating about its respective axis of rotation;

d. the teeth of said toothed members interengaging to define a plurality of expanding and contracting volume chambers;

e. said housing including an end face adjacent said toothed members, said inlet chamber and said outlet chamber defining at said end face, an inlet port and an outlet port, respectively, said inlet port communicating with said expanding volume chambers and said outlet port communicating with said contracting volume chambers; and f. said inlet port being generally arcuate and extending circumferentially from approximately said line of eccentricity on one side of said device to approximately said line of eccentricity on the opposite side of said device, said inlet port being defined by a generally arcuate first surface and a generally arcuate second surface disposed radially inward from said first surface and including a terminal portion disposed on the side of the device having the largest expanding and contracting volume chambers, said terminal portion being defined by said first arcuate surface and a third surface disposed radially between said first and second arcuate surfaces.

5. The device of claim 4 wherein said third surface is disposed radially outward from the axis of said externally-toothed member a distance greater than one-half the major circle diameter thereof.

6. The device of claim 4 wherein the entire area of said terminal portion is in sealing engagement with a tooth of said internally-toothed member when said tooth is circumferentially aligned with said terminal portion, said tooth being disposed between the largest expanding volume chamber and the largest contracting volume chamber.

7. The device of claim 4 wherein said arcuate first surface is disposed from the axis of rotation of said externally-toothed member a distance equal to at least about one-half of the base circle diameter of the internally-toothed member.

8. The device of claim 7 wherein said arcuate second surface is disposed from the axis of rotation of said externally-toothed member a distance approximately equal to one-half of the base circle diameter of said externally-toothed member.

* * * * *